US007832977B2

(12) United States Patent
Brewer, III

(10) Patent No.: US 7,832,977 B2
(45) Date of Patent: Nov. 16, 2010

(54) STACKER CARTS, PRINTING APPARATUSES, AND METHODS OF STACKING MEDIA ON STACKER CARTS

(75) Inventor: Charles Raymond Brewer, III, Farmington, NY (US)

(73) Assignee: Xerox Corporation, Norwalk, CT (US)

( * ) Notice: Subject to any disclaimer, the term of this patent is extended or adjusted under 35 U.S.C. 154(b) by 295 days.

(21) Appl. No.: 12/174,794

(22) Filed: Jul. 17, 2008

(65) Prior Publication Data

US 2010/0014951 A1 Jan. 21, 2010

(51) Int. Cl.
*B65G 57/00* (2006.01)
*B65H 31/00* (2006.01)
*B65H 31/36* (2006.01)

(52) U.S. Cl. ..... 414/788.9; 414/789.9; 271/209; 271/221; 410/46

(58) Field of Classification Search ..... 206/554, 206/600; 220/8; 270/58.18–58.19; 271/161, 271/163, 171, 188, 209, 217, 220; 414/331.06–331.09, 414/331.1, 331.11, 331.14, 331.15, 331.18, 414/593–594, 788, 788.9, 789.7, 789.9, 792.7, 414/793.4, 793.8, 794.6, 923; 493/412
See application file for complete search history.

(56) References Cited

U.S. PATENT DOCUMENTS

| | | | | |
|---|---|---|---|---|
| 815,008 | A * | 3/1906 | Davidson | 271/201 |
| 2,838,185 | A * | 6/1958 | Horstkotte | 414/790.7 |
| 2,991,075 | A * | 7/1961 | Wheeler et al. | 271/161 |
| 3,178,172 | A * | 4/1965 | Lettan | 493/411 |
| 5,322,496 | A * | 6/1994 | Ernst et al. | 493/410 |

* cited by examiner

*Primary Examiner*—Gregory W Adams
(74) *Attorney, Agent, or Firm*—Ronald E. Prass, Jr.; Prass LLP

(57) ABSTRACT

Stacker carts for stacking media, printing apparatuses, and methods of stacking media on stacker carts are disclosed. An embodiment of the stacker carts includes a stacking surface including a first end and an opposite second end, the stacking surface sloping downwardly from the first end toward the second end; and a resiliently-biased stop at the second end of the stacking surface, the stop including at least one contact surface defining a height of the stop above the second end of the stacking surface. When the contact surface is in contact with a first surface, a height of the stop (i) decreases as the stacker cart is moved toward the first surface, and (ii) increases as the stacker cart is moved away from the first surface.

19 Claims, 5 Drawing Sheets

STACKER CARTS, PRINTING APPARATUSES, AND METHODS OF STACKING MEDIA ON STACKER CARTS

BACKGROUND

Stacker carts, printing apparatuses, and methods of stacking media on stacker carts are disclosed.

Stacker carts are used for stacking media in printing apparatuses. Such stacker carts can be loaded while positioned in spaces within such apparatuses. It would be desirable to provide stacker carts that can be used in a small space in a printing apparatus to stack longer printed media.

SUMMARY

According to aspects of the embodiments, stacker carts, printing apparatuses and methods of stacking media on stacker carts are disclosed. An exemplary embodiment of the stacker carts for stacking media comprises a stacking surface including a first end and an opposite second end, the stacking surface sloping downwardly from the first end toward the second end; and a resiliently-biased, movable stop disposed at the second end of the stacking surface, the stop including at least one contact surface defining a height of the stop above the second end. When the contact surface is in contact with a first surface, the height of the stop (i) decreases as the stacker cart is moved toward the first surface, and (ii) increases as the stacker cart is moved away from the first surface.

DRAWINGS

DETAILED DESCRIPTION

The disclosed embodiments include a stacker cart for stacking media, which comprises a stacking surface having a first end and an opposite second end, with the stacking surface sloping downwardly from the first end toward the second end; and a resiliently-biased, movable stop at the second end of the stacking surface. The stop includes at least one contact surface defining a height of the stop above the second end. When the contact surface is in contact with a first surface, the height of the stop (i) decreases as the stacker cart is moved toward the first surface, and (ii) increases as the stacker cart is moved away from the first surface.

The disclosed embodiments further include a stacker cart for stacking media, which comprises a base including a top surface; a stacking surface on the top surface, the stacking surface curving downwardly from a rear end to an opposed front end; and a stop disposed at the front end of the stacking surface. The stop includes a first portion having a first contact surface, a second portion having a second contact surface, and at least one spring connected to the first and second portions. At least one of the first and second contact surfaces defines a height of the stop above the front end. When the first and second contact surfaces are in contact with a first surface, (i) the height of the stop decreases as the stacker cart is moved toward the first surface, and (ii) the spring resiliently-biases the first and second portions to move and increase the height of the stop when the stacker cart is moved away from the first surface.

The disclosed embodiments further include a method of stacking media on a stacker cart comprising a stacking surface which slopes downwardly from a first end toward an opposite second end, and a resiliently-biased stop at the second end. The stop has at least one contact surface defining a height of the stop above the second end. The method comprises raising the stacking cart above a support surface to bring the contact surface into contact with a first surface and decrease the height of the stop; loading at least one medium onto the stacking surface; and lowering the stacking cart relative to the first surface such that the height of the stop increases.

Figure 1:
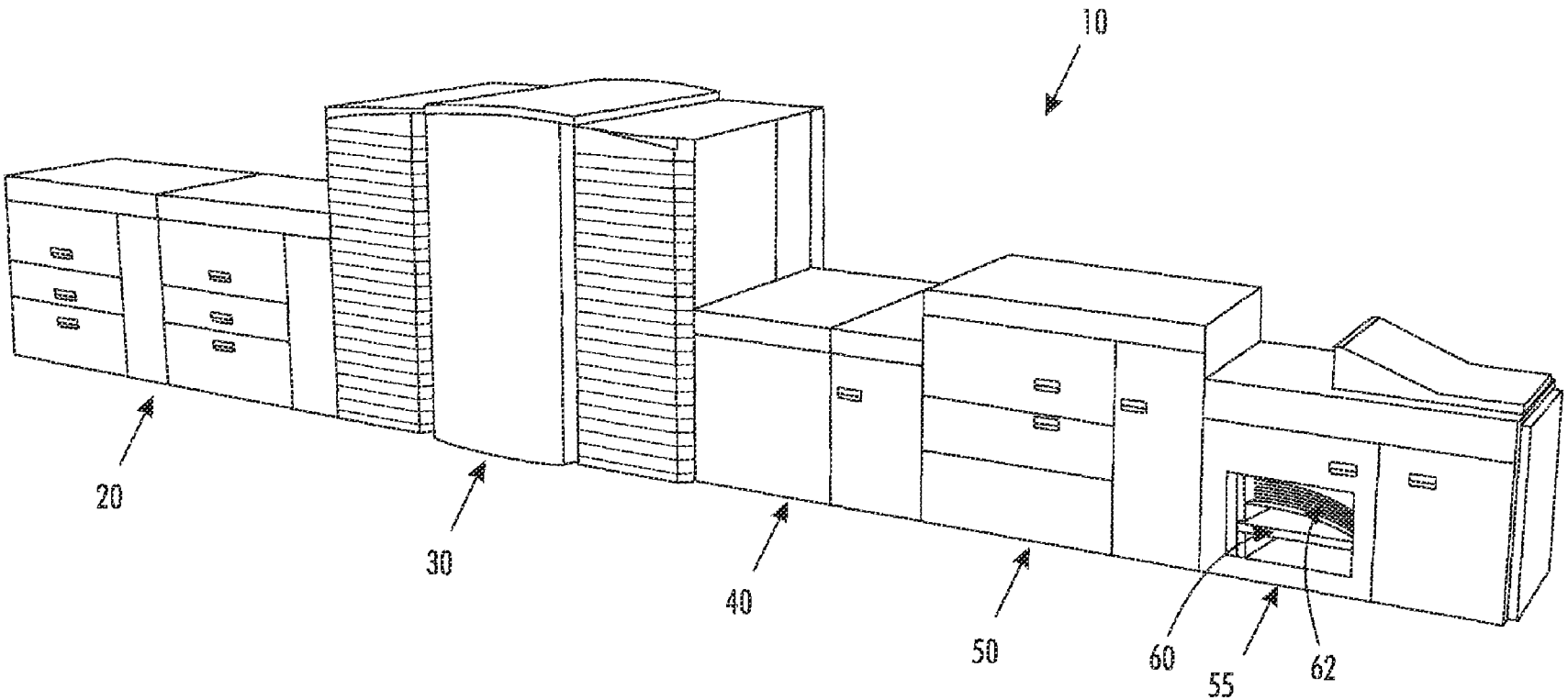
FIG. 1 illustrates an exemplary embodiment of a printing apparatus.

FIG. 1 illustrates an exemplary printing apparatus 10 used to produce prints from media, such as coated or uncoated paper sheets. The apparatus 10 has a modular construction and includes paper feeder modules 20, a printer module 20 adjacent the paper feeder modules 20, an inverter module 40 adjacent the printer module 30, an inserter module 50 adjacent the inverter module 40, and a finisher module 55 adjacent the inserter module 50.

In the apparatus 10, the paper feeder modules 20 can feed media having various sizes (widths and lengths) and weights to the printer module 30. In the printer module 30, latent images are formed on a photoreceptor, such as a photoreceptor belt, using a light source, and dry developer material is used to form toner images on the photoreceptor. The toner images are transferred to a side of respective media fed through the paper path. The inverter module 40 manipulates media exiting the printer module 30 and either passes the media through to the inserter module 50, or inverts and returns the media to the printer module 20, where toner images are formed on the opposite side of these media to produce duplex prints. The inserter module 50 provides an additional media source for the printing process. Media that are inserted into the printing process at the inserter module 50 typically are not passed through the printer modules 20, but are inserted in the process stream to build a finished stack. The finisher module 60 receives media fed through the printer module 30, inverter module 40 and inserter module 50. In the finisher module 60, these media are loaded onto a removable stacker cart to form a stack. FIG. 1 shows a stacker cart 60 positioned in an opening inside of the finisher station 55. Media 62 are stacked on the stacker cart 60. The media can be off-set stacked, or stacked with no offset between sets, on the stacker cart 60.

Figure 2:
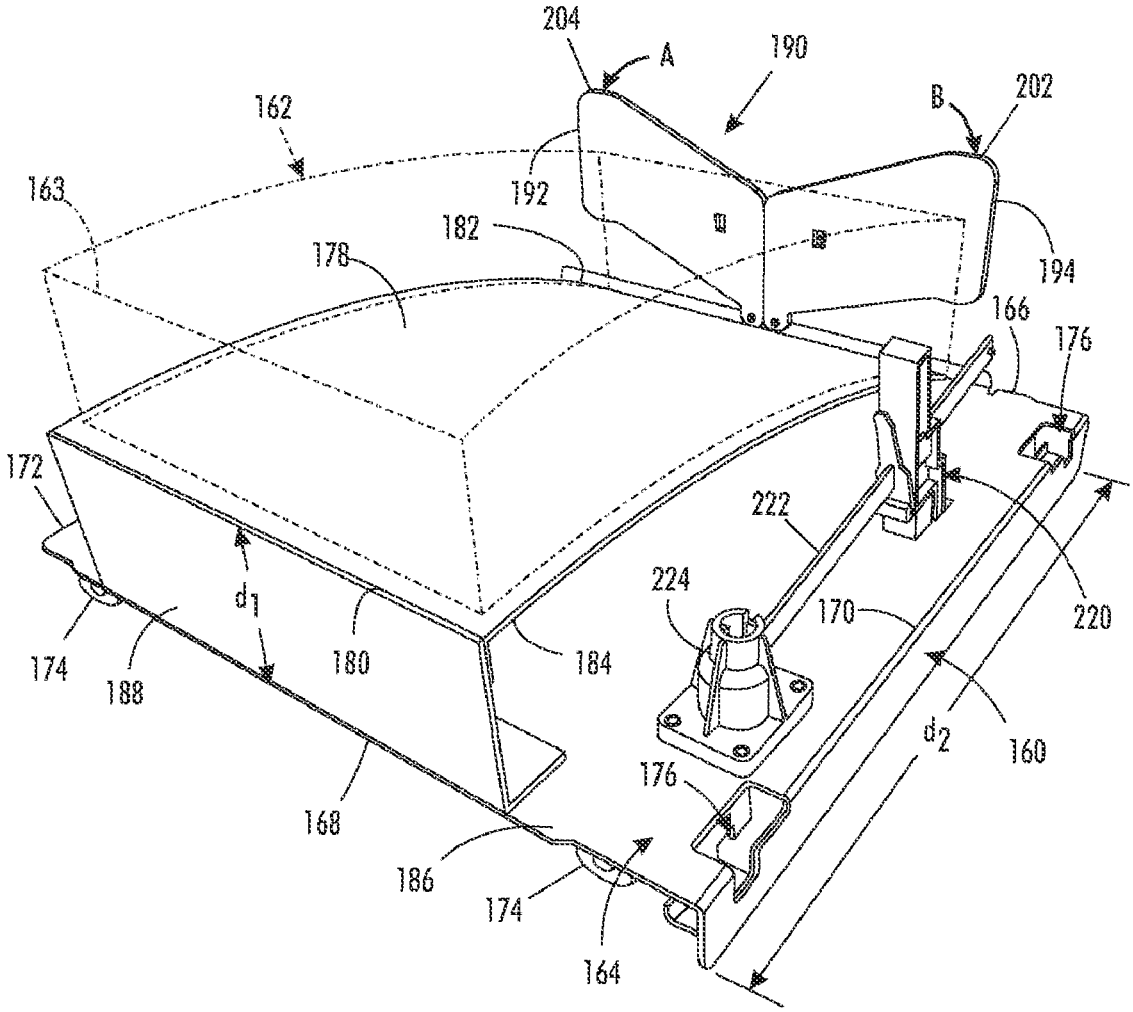
FIG. 2 illustrates an exemplary embodiment of a stacker cart with a stack of media depicted in phantom line.

A stacker cart 160 according to an exemplary embodiment is shown in FIG. 2. The stacker cart 160 includes a base 164 having a front edge 166, rear edge 168 and opposed side edges 170, 172. The base 164 is typically a shaped metallic plate. The base 164 can alternatively be made of other suitably rigid materials, such as polymers. The stacker cart 160 includes rollers 174 attached to the base 164 at each corner to allow the stacker cart 160 to be moved on a surface, such as a horizontal floor, on which the stacker cart 160 is supported. The base 164 includes openings 176 configured to receive a handle member (not shown), which can be grasped by a user to move the stacker cart 160 on the surface.

The stacker cart 160 further includes a stacking surface 178. Media 162 are stacked on the stacking surface 178 when the stacker cart 160 is positioned inside of the finisher station 55. The stacking surface 178 extends from a rear end 180 to a front end 182. When the stacker cart 160 is positioned on a horizontal surface, the rear end 180 is located above the front end 182. In the embodiment, the stacking surface 178 is the top surface of a curved plate 184. The plate 184 can be made, e.g., of metals including steel, aluminum, and the like, or a sufficiently-rigid polymeric material. The distance, $d_1$, from top surface 186 of the base 164 to the rear end 180 of the stacking surface 178 can be, e.g., about 100 mm to about 105 mm. The front end 182 of the stacking surface 178 is positioned above the top surface 186 by a distance equal to the thickness of the plate 184.

The plate 184 is supported on the top surface 186 by an upstanding wall 188. As shown, the wall 188 can be a bracket attached to the tip surface 186 and the plate 184. In other embodiments, the plate 184 and wall 188 can be a single piece of material.

In embodiments, the stacking surface 178 is configured to allow media that are longer than the length, $d_2$, of the base 164 from the front edge 166 to the rear edge 168, to be stacked on the stacking surface 178 without extending outwardly beyond the rear edge 168. In some embodiments, the stacking surface 178 is curved and convex shaped, as shown, such that the stacking surface 178 slopes downwardly from the rear end 180 to the front end 182. In an exemplary embodiment, the stacking cart 160 has a length of about 21 in. (about 533 mm). In such embodiment, media 162 having a length of up to about 22.5 in. (about 572 mm) can be stacked on the stacking surface 178 without extending beyond the rear edge 168 of the stacker cart 164. Accordingly, the stacker cart 160 can be used to stack media that are longer than the length of a space in which the stacker cart 160 is used. The stacking surface 178 typically has a width of about 11 in. (about 279 mm) to about 15 in. (about 381 mm), allowing media widths within this range to be stacked on the stacking surface 178.

In other embodiments, the stacking surface 178 can be planar (not shown) along its entire length between the rear end 180 and the front end 182. In such embodiments, the angle formed between the plane of the stacking surface 178 and the plane of the top surface 186 can be selected to provide the desired length of the stacking surface between the rear end and the front end. In an exemplary embodiment, when the stacker cart 160 has a dimension, $d_2$, of about 21 in., media having a length greater than 21 in., but less than 22.5 in., can be stacked on the planar stacking surface without extending forwardly beyond the rear edge 168 of the stacker cart 160.

The stacker cart 160 further includes a stop 190 located at the front end 182 of the stacking surface 178 and the front edge 166 of the base 164. The stop 190 is movable to change its height with respect to the front end 182 of the stacking surface 178. The stop 190 is configured to prevent media 162 stacked on the stacking surface 178 from sliding off of the front edge 166 of the stacker cart 160. By incorporating the stop 190 on the stacker cart 160, media stacking capacity on the stacker cart 160 reduced by elevating the rear end 180 of the stacking surface 178 above the front end 182 to allow media that are longer than the base 164 to be stacked on the stacker cart 160, can be reclaimed.

In embodiments, the stop 190 is resiliently-biased. The height of the stop 190 relative to the front end 182 of the stacking surface 178 is variable from a minimum height, when the stop 190 is in a fully-lowered position, to a maximum height, when the stop 190 is in a fully-raised position. In the minimum-height position of the stop 190, a portion of the stop 190 can be located below the top surface 186 of the base 184, with the remainder of the stop 190 located above the top surface 186. When the stop 190 is brought into contact with a surface, the stacker cart 164 can then be raised toward the surface in order to push the stop 190 downwardly and decrease its height. Then, when the stacker cart 164 is lowered relative to the surface, the height of the stop 190 increases up to a maximum height when the stop 190 no longer contacts the surface.

As shown in FIG. 2, in embodiments, the stop 190 includes a first portion 192 and a second portion 194. As shown, the first portion 192 and second portion 194 can have a generally polygonal shape, such as rectangular.

Figure 3:
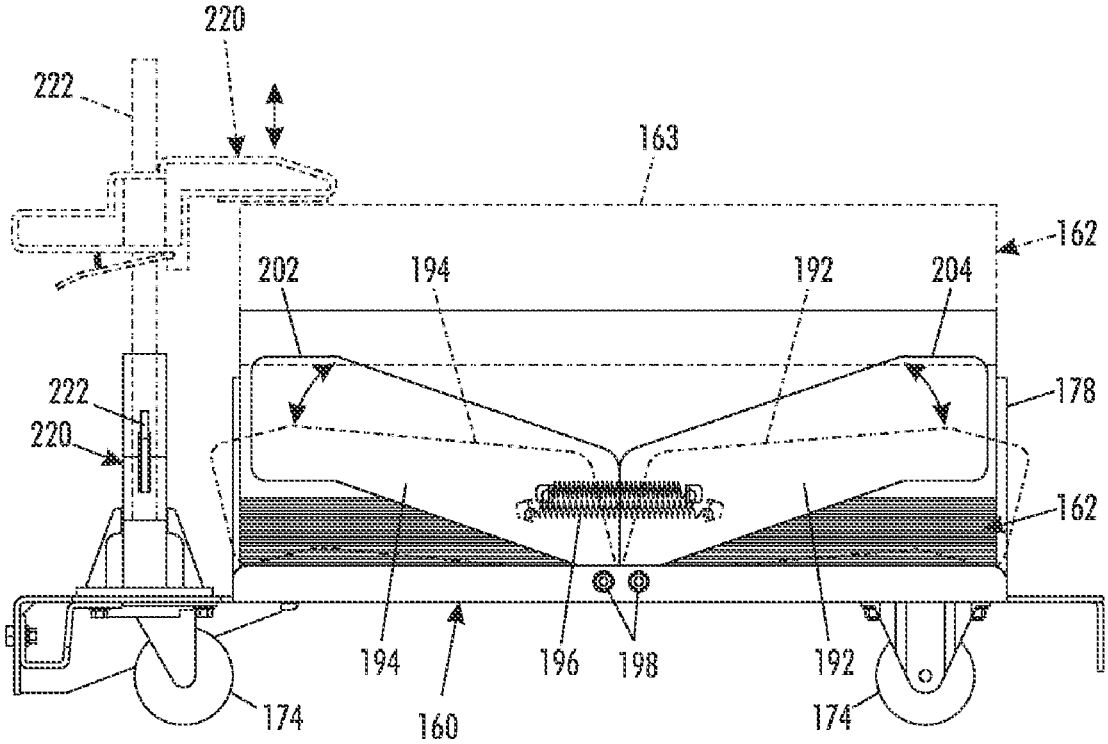
FIG. 3 is a front elevation view of the stacker cart shown in FIG. 2.

As shown in FIG. 3, in embodiments, a spring 196 is connected to the first portion 192 and second portion 194 of the stop 190. The spring 196 exerts a force effective to resiliently bias the first portion 192 relative to the second portion 194 to vary the height of the stop 190. The spring 196 is a tension spring shown in a contracted state. The first portion 192 and second portion 194 are caused to rotate about respective axes 198 in directions away from each other when the top surface 200 of the first portion 192 and the top surface 202 of the second portion 194 are brought into contact with a surface, which is typically stationary, when the stacker cart is being raised relative to the surface. This rotation of the first portion 192 and second portion 194 is depicted by arrows A and B, respectively, in FIG. 2. In FIG. 3, the first portion 192 and second portion 194 are shown in the fully-raised (maximum height) position in solid line, and in a lowered (reduced height) position in phantom line after being rotated downwardly, as depicted by arrows. Contact between the top surfaces 202, 204 and the surface causes the height of the stop 190 to continuously decrease as the stacker cart 160 continues to be raised relative to the surface.

The height of the stop 190 is measured from the front end 182 of the stacking surface 178 to the highest point of the top surface 202, or the top surface 204 above the front end 182. That is, the height of the stop 190 is the maximum distance of the top surface 202 or top surface 204 above the front end 182 above the stacking surface 178. The maximum height of the stop 190 in its fully raised position can be, e.g., about 185 mm to about 190 mm. As the height of the stop 190 decreases, the spring 196 is extended and the spring force increases. When the stacker cart 160 is at the fully-raised position, the stop 190 is at a minimum height, and the spring 196 is fully extended.

Figure 4:
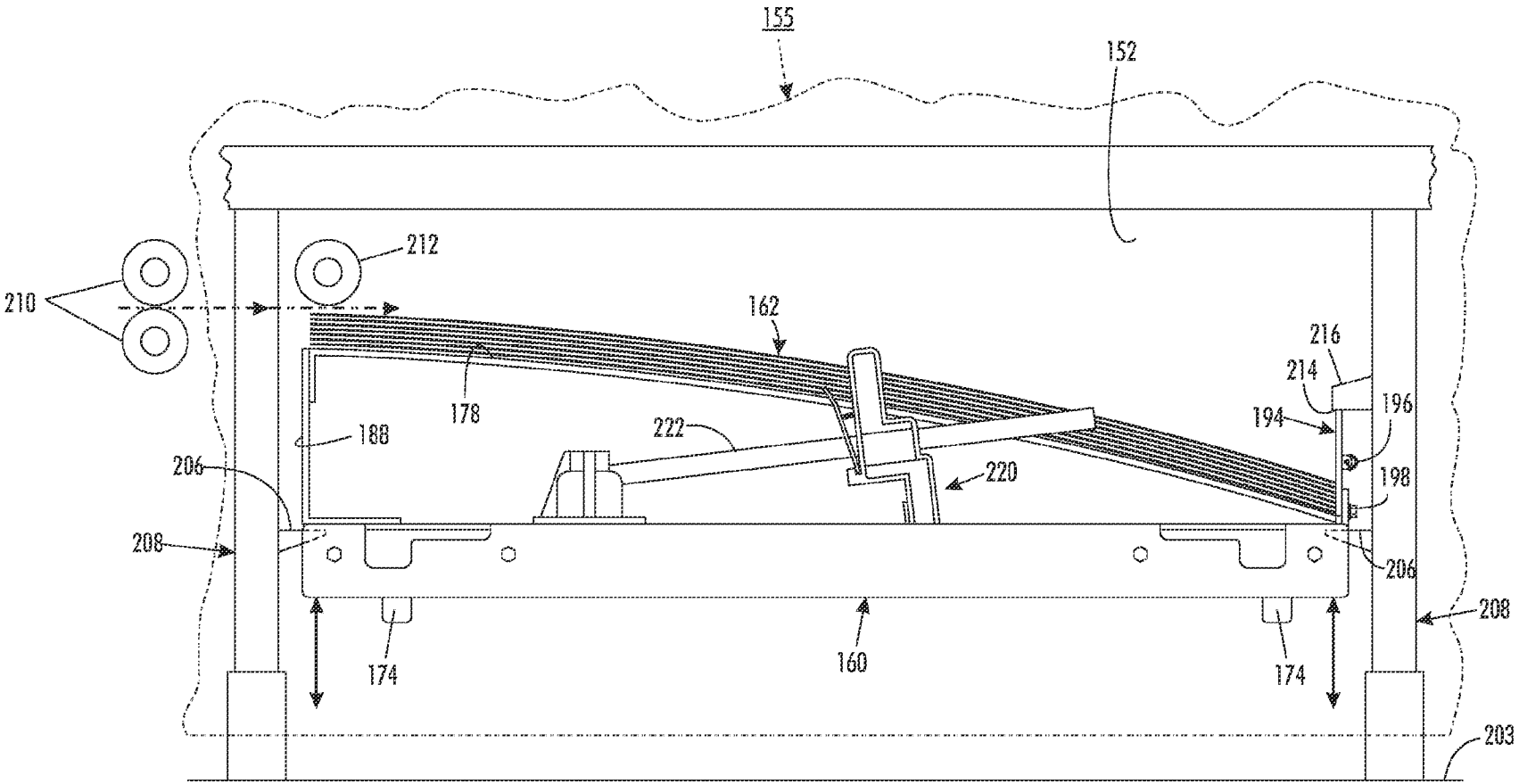
FIG. 4 illustrates the stacker cart shown in FIG. 2 in a raised position inside of a finisher module of a printing apparatus, with media stacked on the stacker cart.
Figure 5:
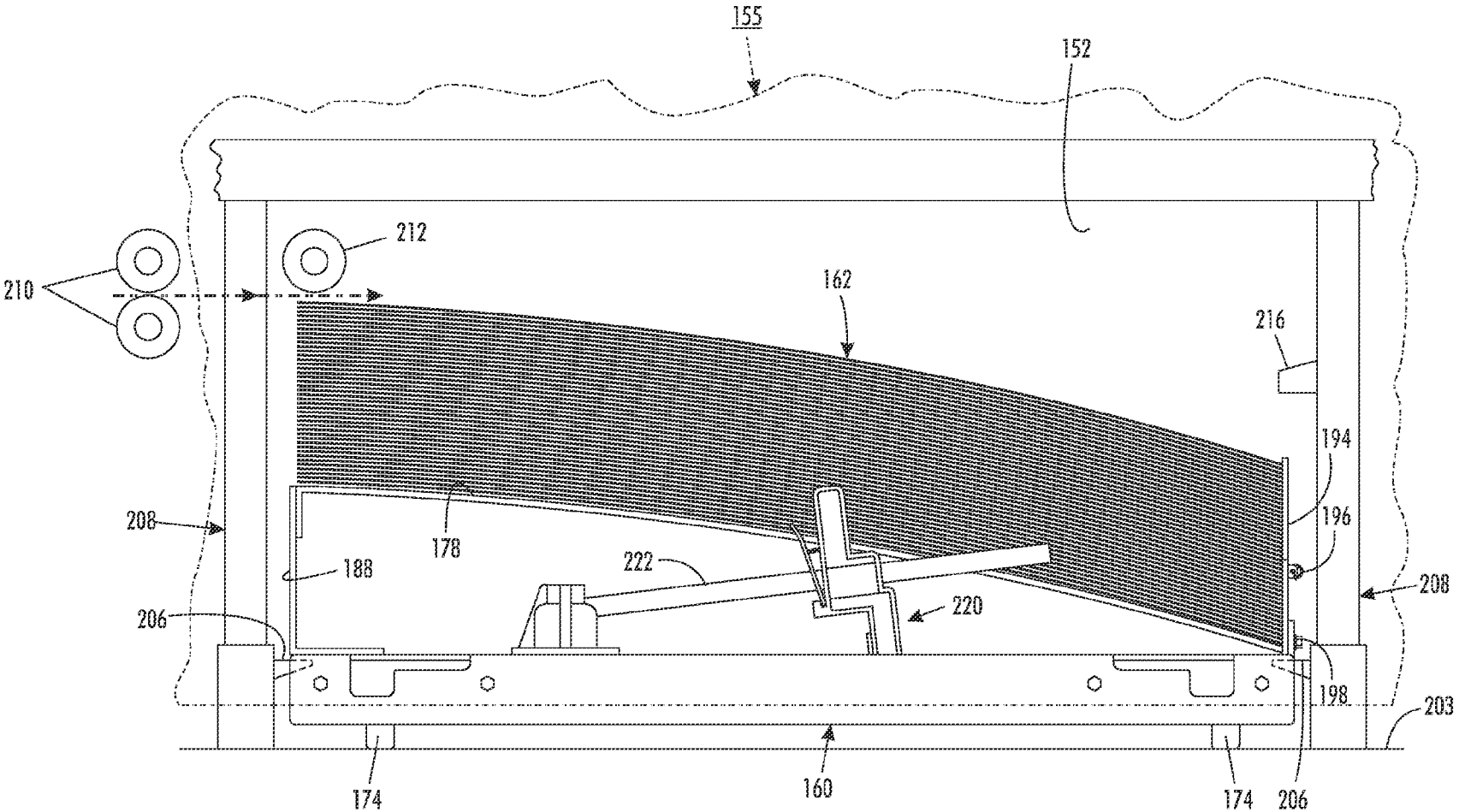
FIG. 5 illustrates the stacker cart shown in FIG. 4 in a fully-lowered position inside of the finisher module, with additional media stacked on the stacker cart.

FIGS. 4 and 5 depict loading of media 162 onto the stacker cart 160 within an opening 152 of a finisher module 155 of a printing apparatus (such the finisher module 55 shown in FIG. 1). FIG. 4 shows the stacker cart 160 after it has been raised to a position above a surface 203 on which the finisher module 155 is supported. The stacker cart 160 is raised and lowered with respect to the surface 203 by a lift mechanism including lift members 206 that move vertically on tracks 208. The lift members 206 are configured to engage the base 164 of the stacker cart 160. In the raised position of the stacker cart 160 shown in FIG. 4, media 162 are automatically stacked on the stacking surface 178 by feeding the media 162 via the rolls 210 and 212. As shown, the stacked media 162 abut the second portion 194 of the stop 190 (and also the first portion 192). In the raised position, the second portion 194 (and also the first portion 192) abut a surface 214 of a stop member 216 provided on one of the tracks 208. In this raised position of the stacker cart 160, the first portion 192 and second portion 194 of the stop 190 are in lowered positions, such as shown in FIG. 3 in phantom line.

As media continue to be stacked on the stacker cart 160, the stacker cart 160 is lowered with respect to the surface 214. As the stacker cart 160 is lowered, the spring 196 continues to contract and apply a tensile force to the first portion 192 and second portion 194, causing these portions to rotate toward each other (i.e., from the phantom line position to the solid line position in FIG. 3). That is, in the view shown in FIG. 3, the first portion 192 rotates counter-clockwise, and the second portion 194 rotates clockwise as the stacker cart 160 is lowered. This rotation of the first portion 192 and second portion 194 toward each other increases the height of the stop 190. By the height of the stop 190 increasing by lowering of the stacker cart 160, additional media 162 can be stacked on the stacking surface 178 until loading of the stacker cart 160 is completed.

FIG. 5 shows the stop 190 in its maximum-height position after the stacker cart 160 has been lowered onto the surface 203. In this position of the stop 190, the stacker cart 160 can be fully loaded, as shown. The stacker cart 160 can then be removed from the opening 152 of the finisher module 155. Typically, media having a total thickness of, e.g., about 180 mm to about 190 mm can be stacked on the stacking surface 178.

In other embodiments, the stop can be a single-piece of material, e.g., a metal or plastic material. In such embodiments, the stop is lowered by bringing the top surface of the stop into contact with a surface, as the stacker cart is raised toward the surface. The stop can be resiliently biased by a compression spring, for example. The compression spring is compressed as the stop is pushed downwardly as the stacker cart is raised. When the stacker cart is in the raised position, media can be loaded onto the stacking surface. The stacker cart can be lowered with respect to the surface and continue to be loaded with the media. As the stacker cart is lowered, the compression spring expands, thereby raising the stop relative to the top surface of the base. This movement of the stop increases its height relative to the top surface, allowing additional media to be stacked on the stacking surface efficiently.

In embodiments of the stacker cart including a multi-piece stop or embodiments including a single-piece stop, movement of the variable-height stop allows the stacker cart to be raised relative to a surface to bring the stacking surface close to the surface so that media can be stacked on the stacking surface.

As shown in FIGS. 2 to 4, in embodiments, the stacker cart 160 can include a clamp 220 provided on the base 164 for clamping media stacked on the stacking surface 178 to prevent the media from falling off of the stacker cart 160. The clamp 220 is mounted on an arm 222. The arm 222 can be rotated and pivoted with respect to a fixed base 224 attached to the base 164 to place the clamp 220 in contact with the top surface of the stack of media 162, as shown in phantom line in FIG. 3.

It will be appreciated that various ones of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. A stacker cart for stacking media, comprising:

a stacking surface including a first end and an opposite second end, the stacking surface sloping downwardly from the first end toward the second end; and a resiliently-biased, movable stop disposed at the second end of the stacking surface, the stop including at least one contact surface defining a height of the stop above the second end, a first portion having a first contact surface, a second portion having a second contact surface, and at least one spring secured to the first portion and second portion, the spring resiliently-biases the first portion and the second portion to move toward each other when the stacker cart is moved away from the first surface;

wherein, when the contact surface is in contact with a first surface, a height of the stop (i) decreases as the stacker cart is moved toward the first surface, and (ii) increases as the stacker cart is moved away from the first surface.

2. The stacker cart of claim 1, wherein the stacking surface is a curved, convex-shaped surface.

3. The stacker cart of claim 1, wherein the stacking surface is planar.

4. The stacker cart of claim 1, further comprising:

a base including opposed first and second edges defining a length of the base;

wherein the first end of the stacking surface is disposed at the first edge, the second end of the stacking surface is disposed at the second edge, and the stacking surface has a length from the first end to the second end which exceeds the length of the base.

5. The stacker cart of claim 1, wherein:

the first portion rotates in a first direction and the second portion rotates in an opposite second direction when the first and second contact surfaces are in contact with the first surface and the stacker cart is moved toward the first surface to decrease the height of the stop; and the first portion rotates in the second direction and the second portion rotates in the first direction when the stacker cart is moved away from the first surface to increase the height of the stop.

6. The stacker cart of claim 1, further comprising:

a plurality of rollers attached to the base and adapted to movably support the stacker cart on a support surface; and a clamp provided on the base for clamping media stacked on the stacking surface.

7. A printing apparatus, comprising:

a finisher station including an opening, the first surface disposed inside the opening, and a lift mechanism; and a stacker cart according to claim 1 removably disposed in the opening and which is raised and lowered with respect to the first surface by the lift mechanism.

8. A stacker cart for stacking media, comprising:

a base comprising a top surface;

a stacking surface on the top surface, the stacking surface curving downwardly from a rear end to an opposed front end; and a stop disposed at the front end of the stacking surface, the stop including a first portion having a first contact surface, a second portion having a second contact surface, and at least one spring connected to the first and second portions, at least one of the first and second contact surfaces defining a height of the stop above the front end;

wherein, when the first and second contact surfaces are in contact with a first surface, (i) the height of the stop decreases as the stacker cart is moved toward the first surface, and (ii) the spring resiliently-biases the first and second portions to move and increase the height of the stop when the stacker cart is moved away from the first surface.

9. The stacker cart of claim 8, wherein:

the base includes a rear edge and an opposed front edge defining a length of the base; and the rear end of the stacking surface is disposed at the rear edge, the front end of the stacking surface is disposed at the front edge, and the stacking surface has a length from the rear end to the front end which exceeds the length of the base.

10. The stacker cart of claim 8, wherein:

the first portion rotates in a first direction and the second portion rotates in an opposite second direction when the first and second contact surfaces are in contact with the first surface and the stacker cart is being moved toward the first surface; and the first portion rotates in the second direction and the second portion rotates in the first direction when the stacker cart is moved away from the first surface.

11. The stacker cart of claim 8, further comprising:

a plurality of rollers attached to the base and adapted to movably support the stacker cart on a support surface; and a clamp provided on the base for clamping media stacked on the stacking surface.

12. A printing apparatus, comprising:

a finisher station including an opening, the first surface disposed in the opening, and a lift mechanism; and a stacker cart according to claim 8 removably disposed in the opening and which is raised and lowered with respect to the first surface by the lift mechanism.

13. A method of stacking media on a stacker cart comprising a stacking surface which slopes downwardly from a first end toward an opposite second end, and a resiliently-biased stop at the second end, the stop including at least one contact surface defining a height of the stop above the second end, a first portion having a first contact surface, a second portion having a second contact surface, and at least one spring connected to the first portion and second portion, the spring resiliently-biases the first portion and the second portion (i) to move away from each other so as to decrease the height of the stop when the stacker cart is toward the first surface, and (ii) to move toward each other so as to increase the height of the stop when the stacker cart is moved away from the first surface, the method comprising:

raising the stacking cart above a support surface to bring the contact surface into contact with a first surface and decrease the height of the stop;

loading at least one medium onto the stacking surface; and lowering the stacking cart relative to the first surface such that the height of the stop increases.

14. The method of claim 13, wherein the medium is paper having an image thereon.

15. The method of claim 13, wherein the first surface is disposed inside of an opening of a finisher station of a printing apparatus.

16. The method of claim 15, further comprising:

prior to raising the stacking cart toward the first surface, placing the stacker cart in the opening of the finisher station;

after loading the medium onto the stacking surface, stacking a plurality of additional media onto the stacking surface as the stacker cart is being lowered away from the first surface toward the support surface; and removing the stacker cart from the opening after the stacker cart has been lowered onto the support surface.

17. The method of claim 13, wherein the stacking surface has a curved, convex shape from the first end to the second end.

18. The method of claim 13, wherein the stacking surface has a planar shape from the first end to the second end.

19. The method of claim 13, wherein:

the stacker cart further comprises a base including a first edge and an opposed second edge defining a length of the base;

the first end of the stacking surface is disposed at the first edge, the second end of the stacking surface is disposed at the second edge, and the stacking surface has a length from the first end to the second end which exceeds the length of the base; and the medium has a length equal to about the length of the stacker surface.

* * * * *